US008976632B2

(12) United States Patent
Takasawa et al.

(10) Patent No.: US 8,976,632 B2
(45) Date of Patent: Mar. 10, 2015

(54) TIMEPIECE FACEPLATE AND TIMEPIECE

(75) Inventors: Koki Takasawa, Nagano (JP); Takumi Oshio, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 37 days.

(21) Appl. No.: 13/330,889

(22) Filed: Dec. 20, 2011

(65) Prior Publication Data

US 2012/0155225 A1 Jun. 21, 2012

(30) Foreign Application Priority Data

Dec. 20, 2010 (JP) ..... 2010-283365

(51) Int. Cl.
*G04B 19/00* (2006.01)
*G04B 19/12* (2006.01)
*G04B 45/00* (2006.01)

(52) U.S. Cl.
CPC ..... *G04B 19/12* (2013.01); *G04B 45/0076* (2013.01)
USPC ..... 368/232; 368/234; 368/205

(58) Field of Classification Search
CPC ..... G04C 10/02; G04B 19/12; G04B 19/10
USPC ..... 368/205, 223, 232, 234; 359/599
See application file for complete search history.

(56) References Cited

U.S. PATENT DOCUMENTS

2003/0070706 A1* 4/2003 Fujioka ..... 136/251
2004/0032797 A1* 2/2004 Sato et al. ..... 368/232
2005/0024754 A1* 2/2005 Epstein et al. ..... 359/831
2008/0159083 A1 7/2008 Kawakami
2009/0073565 A1* 3/2009 Hsu et al. ..... 359/599
2009/0126792 A1* 5/2009 Gruhlke et al. ..... 136/259
2010/0046103 A1* 2/2010 Yeh et al. ..... 359/831
2010/0053752 A1* 3/2010 Omata et al. ..... 359/487
2010/0085735 A1* 4/2010 Kim et al. ..... 362/97.2
2011/0037736 A1* 2/2011 Epstein et al. ..... 345/204
2011/0114176 A1* 5/2011 Slager ..... 136/257

FOREIGN PATENT DOCUMENTS

EP 1852754 A1 11/2007
EP 2058715 A1 5/2009
JP 2007-003356 A 1/2007
JP 2009-222605 A 10/2009

OTHER PUBLICATIONS

Extended European Search Report dated Mar. 20, 2012 for the corresponding European Patent Application No. 11194022.7.

* cited by examiner

*Primary Examiner* — Amy Cohen Johnson
*Assistant Examiner* — Matthew Powell
(74) *Attorney, Agent, or Firm* — Global IP Counselors, LLP

(57) ABSTRACT presenting A timepiece faceplate includes a plate-shaped member provided on one surface with a ridge having a function for reflecting and scattering incident light, which is made of a material having optical transmission properties; and a layer in which numerous powder particles having a function for reflecting light are dispersed and which faces a surface opposite from the surface on which the ridge of the plate-shaped member is provided. The plate-shaped member and the layer of the timepiece faceplate are superimposed when viewed from above.

6 Claims, 10 Drawing Sheets

TIMEPIECE FACEPLATE AND TIMEPIECE

CROSS-REFERENCE TO RELATED APPLICATIONS

This application claims priority to Japanese Patent Application No. 2010-283365 filed on Dec. 20, 2010. The entire disclosure of Japanese Patent Application No. 2010-283365 is hereby incorporated herein by reference.

BACKGROUND

1. Technical Field

The present invention relates to a timepiece faceplate and a timepiece.

2. Background Technology

Timepieces and timepiece faceplates require functionality as a commercial product and decorative aspects (an aesthetic appearance) as a decorative ornament. Well-known faceplates for a timepiece are typically composed of a metal material in order to yield an appearance that imparts a sense of luxury. There have also been attempts to use a faceplate composed of an alloy having a complex composition in order to obtain an appearance that is not as readily achieved using pure gold, pure silver, or other pure materials (e.g., see Patent Document 1).

However, with a well-known timepiece faceplate, the range of appearance that can be expressed is limited, and it is not possible to sufficiently respond to the needs of consumers. For example, there are also decorative ornaments in which fur is used, but a timepiece is a precision instrument, and it is therefore not possible to provide a furred timepiece faceplate due to concerns about damage from fallen hair or other adverse events.

Japanese Patent Application Publication No. 2009-222605 (Patent Citation 1) is examples of the related art.

SUMMARY

Problems to be Solved by the Invention

An advantage of the invention is to provide a timepiece faceplate that has a furred appearance that has not been achieved in the past, and to provide a timepiece provided with the timepiece faceplate.

Means Used to Solve the Above-Mentioned Problems

The advantages described above are achieved by the invention described below.

The timepiece faceplate of the invention is characterized in including: a plate-shaped member provided on one surface with a ridge having a function for reflecting and scattering incident light, the plate-shaped member made of a material having optical transmission properties; and a layer that independently presents a lame-style appearance, wherein the plate-shaped member and the layer are superimposed when viewed from above. It is thereby possible to provide a timepiece faceplate presenting a furred appearance that has been impossible to achieve in the past.

The timepiece faceplate of the invention is characterized in including: a plate-shaped member provided on one surface with a ridge having a function for reflecting and scattering incident light, the plate-shaped member made of a material having optical transmission properties; and a dispersion layer in which are dispersed numerous powder particles having a function for reflecting light, wherein the plate-shaped member and the dispersion layer are superimposed when viewed from above. It is thereby possible to provide a timepiece faceplate presenting a furred appearance that has been impossible to achieve in the past.

The timepiece faceplate of the invention is characterized in including: a plate-shaped member provided on one surface with a ridge having a function for reflecting and scattering incident light, the plate-shaped member made of a material having optical transmission properties; and a layer on which numerous pyramidal projections are provided to one main surface, wherein the plate-shaped member and the layer are superimposed when viewed from above. It is thereby possible to provide a timepiece faceplate presenting a furred appearance that has been impossible to achieve in the past.

According to the timepiece faceplate of the invention, the layer preferably has triangularly pyramidal projections as the projections. It is thereby possible to provide a timepiece faceplate that presents an appearance with an abundantly more luxurious look, such as that of mink fur. According to the timepiece faceplate of the invention, it is preferred that the layer be provided with, as the projections, modified triangularly pyramidal projections in which the centroid of a triangle of a bottom surface of the triangularly pyramidal projection does not align with the apex of the projection when the timepiece faceplate is viewed from above; and the modified triangularly pyramidal projections satisfy, between projections that are adjacent so as to share one side of the triangle of the bottom surface, a symmetrical relationship in which a plane parallel to the normal of the timepiece faceplate including the side is a plane of symmetry, and/or a symmetrical relationship in which a line parallel to the normal of the timepiece faceplate including a point on the side is an axis of symmetry. It is thereby possible to provide the appearance of a timepiece faceplate with a richer stereoscopic effect and a greater sense of luxury.

According to the timepiece faceplate of the invention, the ratio of the number of modified triangularly pyramidal projections among the projections provided to the timepiece faceplate is preferably 80% or higher. It is thereby possible to provide the appearance of a timepiece faceplate with a richer stereoscopic effect and a greater sense of luxury. According to the timepiece faceplate of the invention, the ratio of the number of modified triangularly pyramidal projections provided to the timepiece faceplate that satisfy the symmetrical relationship is preferably 70% or higher. It is thereby possible to provide the appearance of a timepiece faceplate with a richer stereoscopic effect and a greater sense of luxury.

According to the timepiece faceplate of the invention, the bottom surface of the projection forms the shape of an isosceles triangle. It is thereby possible to provide the appearance of a timepiece faceplate with a richer stereoscopic effect and a greater sense of luxury. According to the timepiece faceplate of the invention, the average pitch of the ridges in a cross section of the faceplate along a direction perpendicular to a tangent to the ridges and in a thickness direction of the plate-shaped member preferably 20 μm or more and 100 μm or less. It is thereby possible to impart a particularly excellent aesthetic appearance to a timepiece faceplate.

According to the timepiece faceplate of the invention, the average height of the ridges of the plate-shaped member is preferably 10 μm or more and 50 μm or less. It is thereby possible to impart a particularly excellent aesthetic appearance to a timepiece faceplate. According to the timepiece faceplate of the invention, the plate-shaped member preferably has a plurality of the ridges provided in a concentrically circular fashion when the timepiece faceplate is viewed from above. It is thereby possible to impart a particularly excellent aesthetic appearance to a timepiece faceplate. The timepiece of the invention is characterized in being provided with the timepiece faceplate of the invention. It is thereby possible to provide a timepiece provided with a timepiece faceplate presenting a furred appearance that has been impossible to achieve in the past.

Effect of the Invention

According to the invention, it is possible to provide a timepiece faceplate presenting a furred appearance that has been impossible to achieve in the past, and to provide a timepiece provided with the timepiece faceplate.

BRIEF DESCRIPTION OF THE DRAWINGS

Referring now to the attached drawings which form a part of this original disclosure.

DETAILED DESCRIPTION OF EXEMPLARY EMBODIMENTS

Preferred embodiments of the invention are described below with reference to the accompanying drawings. A preferred embodiment of the timepiece faceplate of the invention will be described first.

Timepiece Faceplate
(First Embodiment)

Figure 1:
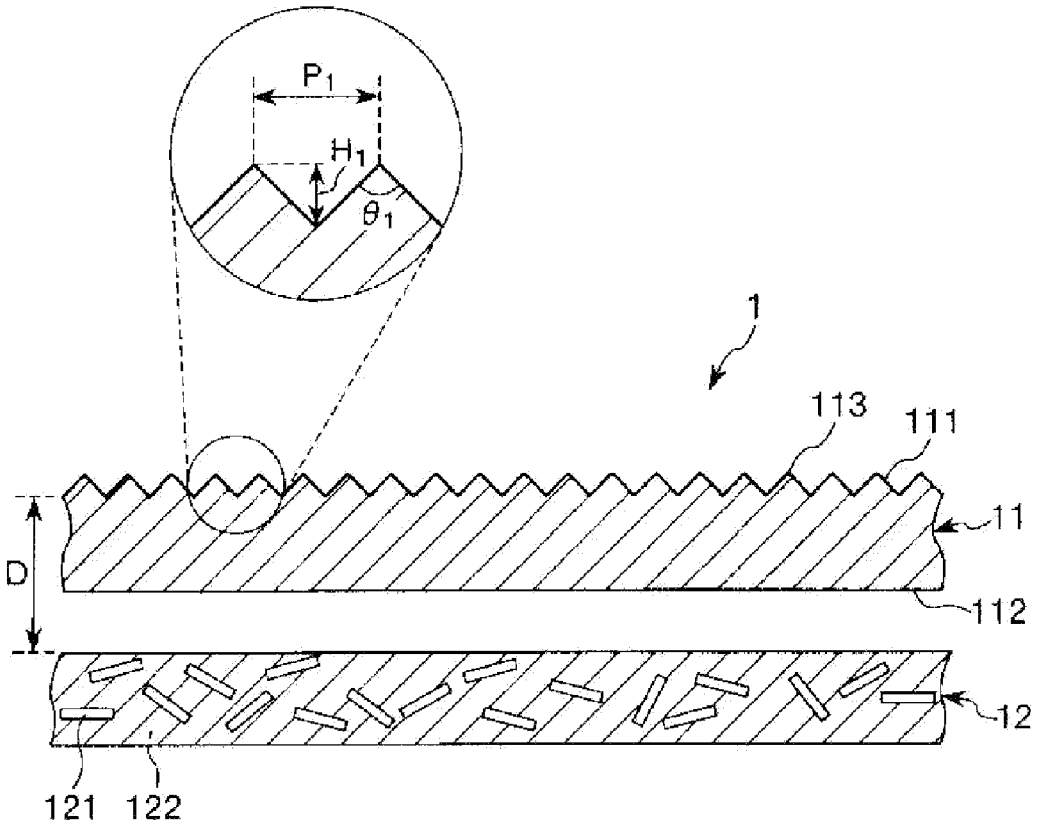
FIG. 1 is a cross-sectional view showing a first embodiment of the timepiece faceplate of the invention.
Figure 2:
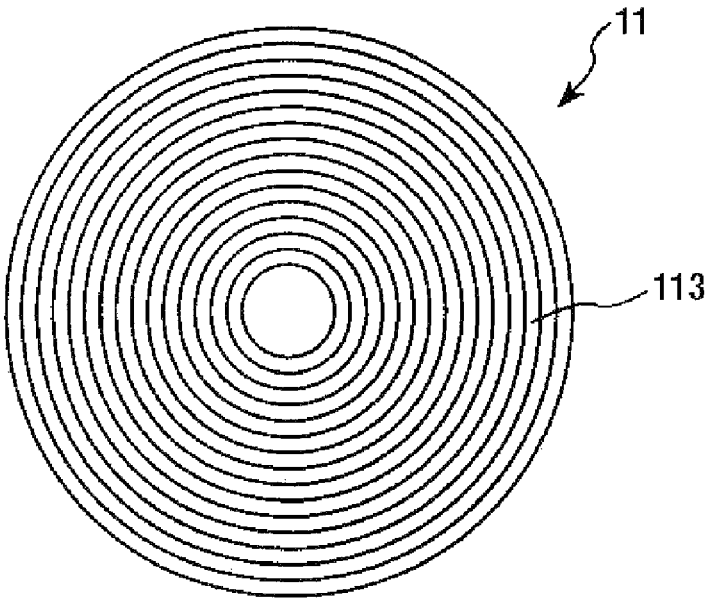
FIG. 2 is a plan view schematically showing an example of a pattern in which ridges of the plate-shaped member are arranged.
Figure 3:
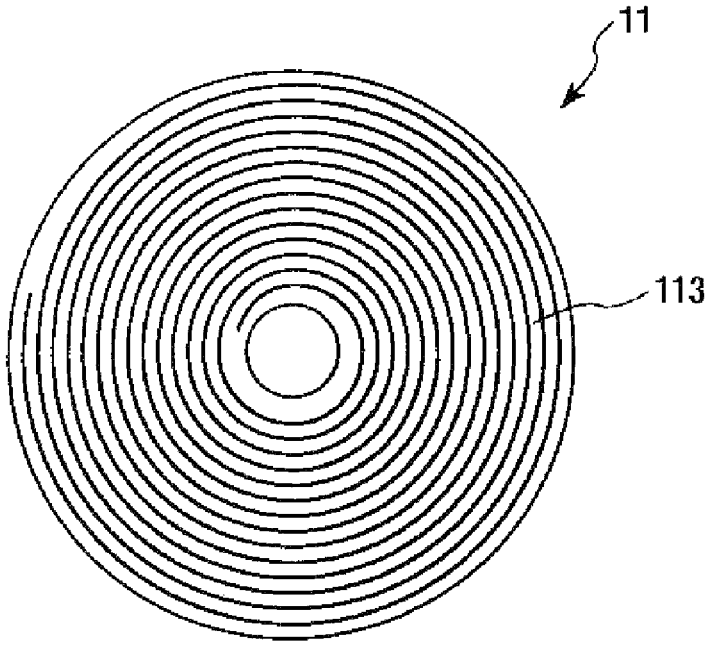
FIG. 3 is a plan view schematically showing an example of a pattern in which ridges of the plate-shaped member are arranged.
Figure 4:
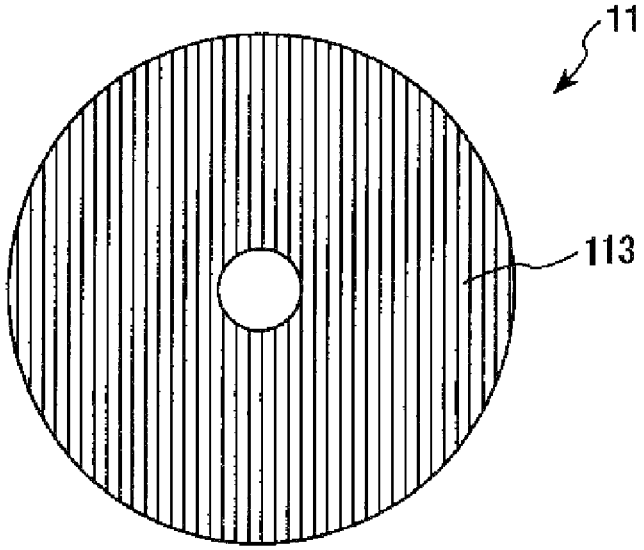
FIG. 4 is a plan view schematically showing an example of a pattern in which ridges of the plate-shaped member are arranged.
Figure 5:
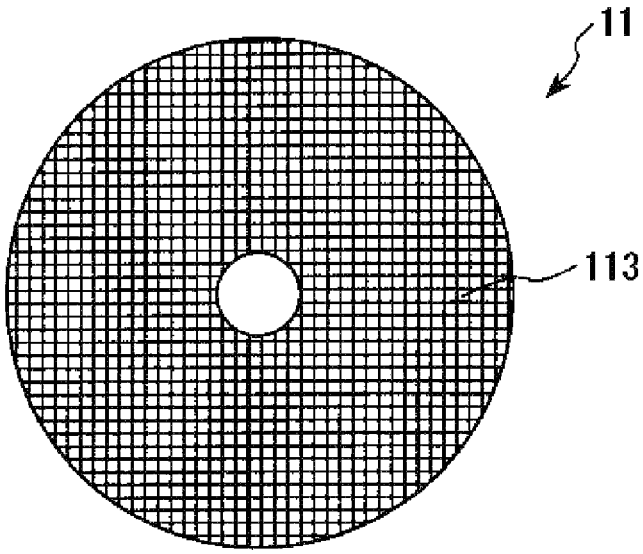
FIG. 5 is a plan view schematically showing an example of a pattern in which ridges of the plate-shaped member are arranged.
Figure 6:
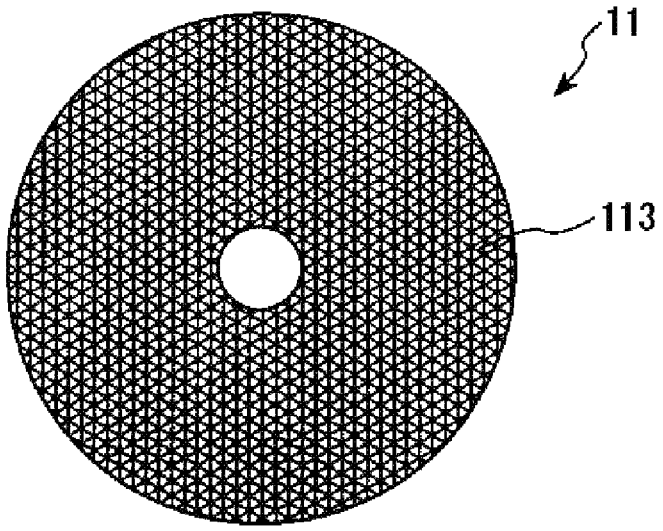
FIG. 6 is a plan view schematically showing an example of a pattern in which ridges of the plate-shaped member are arranged.
Figure 10:
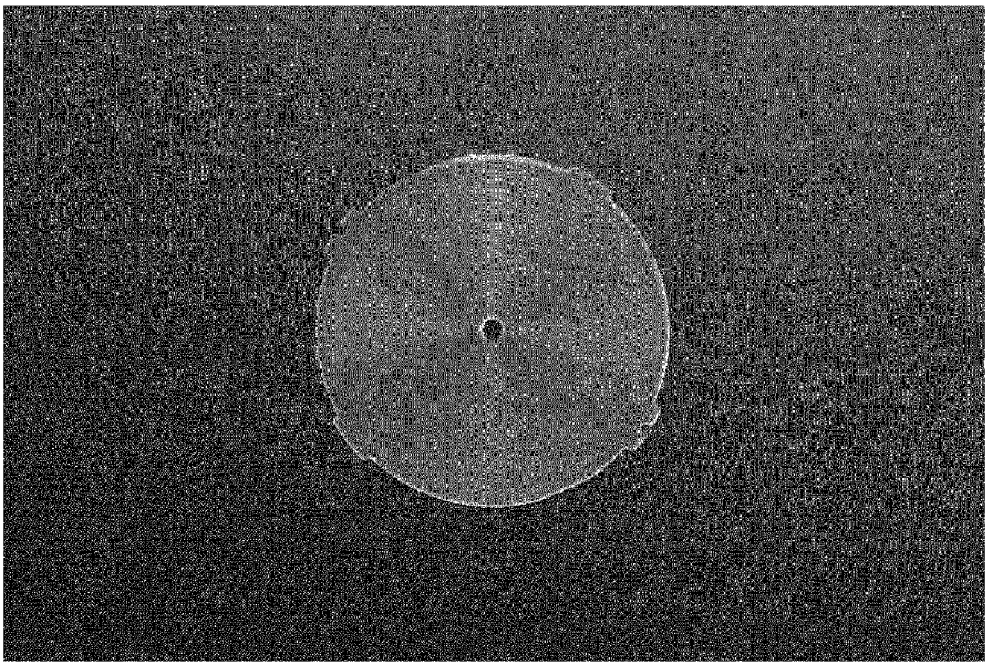
FIG. 10 is a photograph showing an example of the plate-shaped member of the timepiece faceplate of the first embodiment of the invention.
Figure 11:
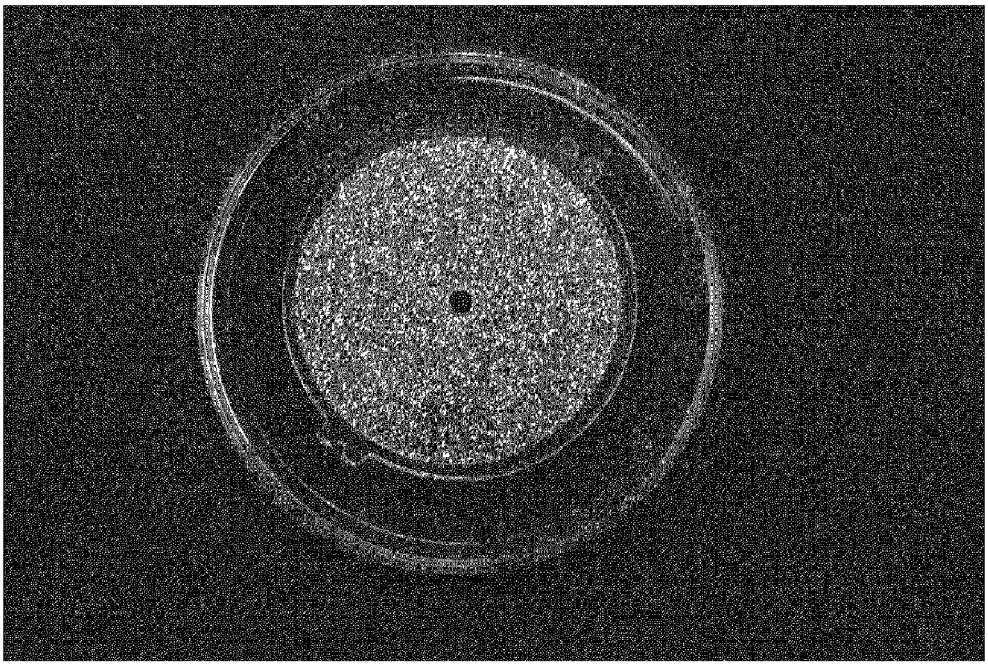
FIG. 11 is a photograph showing an example of the layer 12 of the timepiece faceplate of the first embodiment of the invention.

FIG. 1 is a cross-sectional view showing a first embodiment of the timepiece faceplate of the invention. FIGS. 2 to 6 are plan views schematically showing examples of a pattern in which ridges of the plate-shaped member are arranged. FIG. 10 is a photograph showing an example of a layer 12 of the timepiece faceplate of the present embodiment. FIG. 11 is a photograph showing the timepiece faceplate of the present embodiment provided with the layer 12 shown in FIG. 10.

As shown in FIG. 1, the timepiece faceplate 1 of the present embodiment is provided with an optically transparent plate-shaped member 11. The plate-shaped member 11 is provided with ridges 113 that have a function for reflecting and scattering incident light and that are provided on one surface (a first surface) 111. The timepiece faceplate 1 is provided with a layer 12 that, by itself, presents a lame-style appearance on the surface (second surface) 112 opposite from the surface (first surface) 111 on which the ridges 113 of the plate-shaped member 11 are provided.

The plate-shaped member 11 and the layer 12 are superimposed when viewed from above. The timepiece faceplate 1, by having such a configuration, presents a furred appearance that has been impossible to achieve in the past. In particular, the timepiece faceplate of the present embodiment has, as the layer 12, a layer (dispersion layer) 12 in which numerous powder particles 121 having a function for reflecting light are dispersed. It is thereby possible to impart a particularly excellent furred appearance to the timepiece faceplate 1. The timepiece faceplate 1 is used such that the first surface 111 side of the plate-shaped member 11 faces the observer side (exterior surface side).

Plate-Shaped Member 11

The plate-shaped member 11 is composed of a material having optical transmission properties. In the invention, the phrase "having optical transmission properties" refers to having a property in which at least a portion of light in the visible light region (380 to 780 nm) is transmitted; the transmissivity of light in the visible light region is preferably 50% or more; and the transmissivity of light in the visible light region is more preferably 60% or more. Such light transmissivity can be obtained by using, e.g., a white fluorescent light (FL20S-D65: a fluorescent light for examination manufactured by Toshiba Corp.) as the light source, and by using the ratio $((Y/X)\times 100[\%])$, wherein X is the electric current value when power is generated at 1000 lux using only a solar cell (solar battery) having the same shape as the member to be measured (or the timepiece faceplate), and Y is the electric current value when power is generated in the same state except that the member to be measured (or the timepiece faceplate) is placed on the light source side of the solar cell. Unless otherwise stated in the present specification, the term "light transmissivity" refers to the value obtained under these conditions.

Examples of the material constituting the plate-shaped member 11 include a variety of plastic or glass materials, but it is preferred that the plate-shaped member 11 be mainly composed of a plastic material. Plastic materials typically have excellent moldability (degree of freedom of molding), and can be advantageously used for manufacturing the timepiece faceplate 1 in various shapes. A plate-shaped member 11 composed of a plastic material is advantageous for reducing the manufacturing cost of the timepiece faceplate 1. Plastic materials typically have excellent light (visible light) transmissivity, and excellent radio wave transmissivity. Therefore, when the plate-shaped member 11 is composed of a plastic material, the timepiece faceplate 1 can be advantageously applied to a radio timepiece such as that described below. The focus of the description below is an example in which the plate-shaped member 11 is mainly composed of a plastic material. In the present embodiment, the term "mainly" refers to a component present in the greatest amount among the materials constituting the parts (members) under discussion. The amount is not particularly limited, but the ratio of the material constituting the part (member) under discussion is preferably 60 wt % or more, more preferably 80 wt % or more, and even more preferably 90 wt % or more.

The plastic material constituting the plate-shaped member 11 may be any of a variety of thermoplastic resins, thermosetting resins, or the like, examples of which including polycarbonate (PC), acrylonitrile-butadiene-styrene copolymer (ABS resin), polymethyl methacrylate (PMMA), and other acrylic resins; polyethylene (PE), polypropylene (PP), and other polyolefin resins; polyethylene terephthalate (PET) and other polyester resins; and copolymers, blends, polymer alloys, or the like composed mainly of these. Also, one or more of these may be used in combination (e.g., blend resins, polymer alloys, laminates, and the like). It is particularly preferred that the plate-shaped member 11 be mainly composed of polycarbonate and/or an acrylonitrile-butadiene-styrene copolymer. The strength of the overall timepiece faceplate 1 can thereby be particularly high. A timepiece faceplate 1, even one having more complex shapes, can be readily and reliably manufactured because the degree of freedom for molding the plate-shaped member 11 is increased (ease of molding is improved). Polycarbonate is a relatively inexpensive plastic material, which can contribute to an even further reduction in the cost of manufacturing the timepiece faceplate 1. ABS resin also has particularly excellent chemical resistance and can further improve the durability of the overall timepiece faceplate 1.

The plate-shaped member 11 may include components other than a plastic material. Examples of such components include plasticizers, antioxidants, colorants (including various color formers, fluorescent substances, phosphorescent substances, and the like), brighteners, and fillers. For example, when the plate-shaped member 11 is composed of a material that includes a colorant, color variations of the timepiece faceplate 1 can be increased.

The plate-shaped member 11 may have a substantially uniform composition in each part, or may have a different composition depending on the part. The refractive index (absolute refractive index) of the plate-shaped member 11 is preferably 1.500 or more and 1.650 or less, and more preferably 1.550 or more and 1.600 or less. As described below, light can thereby be more advantageously reflected and scattered, and both an exceptional aesthetic appearance as well as exceptional light transmissivity of the timepiece faceplate 1 can be realized. As described above, the plate-shaped member 11 has ridges 113 that are provided to the first surface 111 and that have a function for reflecting and scattering incident light from the first surface 111 side.

Since the plate-shaped member 11 has optical transmission properties, some light from the exterior of the timepiece faceplate 1 (light from the upper side in FIG. 1) enters the interior of the plate-shaped member 11. Light that has entered the interior of the plate-shaped member 11 travels from the first surface 111 side toward the second surface 112 side, and a portion of the light exits from the second surface 112 side (i.e., passes through the plate-shaped member 11), but the other portion is reflected and scattered by the ridges 113 provided to the first surface 111.

The ridges 113 may be in any arrangement, but an orderly arrangement is preferred when the plate-shaped member 11 is viewed from above. It is thereby possible to impart a particularly excellent aesthetic appearance to the timepiece faceplate 1. Examples of a pattern in which the ridges 113 are arranged (the arrangement pattern when viewed from above) include a pattern in which a plurality of the ridges 113 are arranged in concentric circles (see FIG. 2), and a pattern in which the ridges 113 are arranged in a spiral shape (see FIG. 3). Other examples include a pattern in which numerous ridges 113 are arranged in a single direction (see FIG. 4), and a pattern in which numerous ridges 113 are arranged in two directions (see FIGS. 5 and 6).

Particularly preferred among the arrangement patterns of the ridges 113 is one in which a plurality of the ridges 113 are arranged in concentric circles. It is thereby possible to impart a particularly excellent aesthetic appearance to the timepiece faceplate 1. There are no particular limitations as to the average value of the pitch $P_1$ (average pitch) of the ridges 113 in a cross section of the faceplate in a direction perpendicular to a tangent of the ridges 113 and in a thickness direction of the plate-shaped member 11; however, 20 μm or more and 100 μm or less is preferred, and 30 μm or more and 70 μm or less is more preferred. When the average value of the pitch $P_1$ (average pitch) of the ridges 113 is a value within the stated range, it is possible to impart a particularly excellent aesthetic appearance to the timepiece faceplate 1.

There are no particular limitations as to the average value of the height $H_1$ (average height) of the ridges 113; however, 10 μm or more and 50 μm or less is preferred, and 15 μm or more and 35 μm or less is more preferred. When the average value of the height $H_1$ (average height) of the ridges 113 is a value within the stated range, it is possible to impart a particularly excellent aesthetic appearance to the timepiece faceplate 1 while the light transmissivity of the timepiece faceplate 1 is made sufficiently high.

In the configuration shown in the drawings, the cross-sectional shape of the ridges 113 in the cross section is in the shape of an isosceles triangle. When the cross-sectional shape of the ridges 113 is such a shape, the light incident from the first surface 111 side can be suitably reflected and scattered, and it is possible to impart a particularly excellent aesthetic appearance to the timepiece faceplate 1. There are no particular limitations as to the angle ($\theta_1$ in the drawing) of the apex of the ridges 113; however, 70° or more and 100° or less is preferred, and 90° is more preferred. The light incident from the first surface 111 side can be suitably reflected and scattered, and it is possible to impart a particularly excellent aesthetic appearance to the timepiece faceplate 1.

The second surface 112 of the plate-shaped member 11 may be relatively flat (smooth), and be provided with a radial shape, a spiral, or in another design, but it is preferred that a radial design be provided. It is thereby possible to provide a timepiece faceplate 1 that presents a much more luxurious appearance such as that of mink fur. The surface roughness Ra of the second surface 112 is preferably 0.001 μm or more and 5.0 μm or less, and is more preferably 0.001 μm or more and 2.5 μm or less. Effects such as those described above can thereby be more dramatically demonstrated. There are no particular limitations as to the shape and size of the plate-shaped member 11; however, these parameters are ordinarily determined on the basis of the size and shape of the timepiece faceplate 1 to be manufactured. In the configuration shown in the drawings, the plate-shaped member 11 has a flat shape, but may be, e.g., a curved plate shape.

There are no particular limitations as to the average thickness of the plate-shaped member 11; however, it is preferably 50 μm or more and 700 μm or less, more preferably 100 μm or more and 600 μm or less, and even more preferably 150 μm or more and 500 μm or less. When the average thickness of the plate-shaped member 11 is a value in the above-stated range, it is possible to more effectively prevent the characteristic colors of a solar battery from being seen and to impart a particularly excellent aesthetic appearance (a sense of luxury) while the light transmissivity of the timepiece faceplate 1 is made sufficiently high. When the average thickness is a value in the above-state range, the stability of the mechanical strength and shape of the timepiece faceplate 1 can be made sufficiently excellent while the timepiece to which the timepiece faceplate 1 is applied can be effectively prevented from being made thicker.

The plate-shaped member 11 may be molded using any method; examples of methods for molding the plate-shaped member 11 including compression molding, extrusion molding, injection molding, and photo fabrication. It is also possible to prepare a plate-shaped member devoid of asperities, and perform cutting work or the like on the plate-shaped member to manufacture a plate-shaped member 11 on which the ridges 113 are provided. Since ridges and grooves correspond with each other, providing grooves in the plate-shaped member 11 will result in the other parts becoming the ridges 113.

Layer 12

The layer 12, by itself, presents a lame-style appearance. When the plate-shaped member 11 is provided with such a layer 12, light that has passed through the plate-shaped member 11 is reflected by the layer 12, and the light reflected by the layer 12 is perceived by an observer to be extended by the ridges 113 of the plate-shaped member 11. Therefore, an appearance such as that of animal hair is presented, the appearance of the overall timepiece faceplate 1 is one of glossy animal fur, and an abundantly luxurious feel is perceived.

In particular, with the present embodiment, the layer 12 has a configuration in which scaly powder particles (glossy powder particles) 121 having a function for reflecting light are numerously dispersed in a curing part 122 composed of a curable substance made of curable resin. When the layer 12 has such a configuration, it is possible to impart a particularly excellent aesthetic appearance to a timepiece faceplate 1. In the case that the layer 12 has a configuration such as that described above and the entire layer 12 has optical transmission properties, the incident light inside the layer 12 is repeatedly reflected at the surfaces of the numerous powder particles 121, a portion of the light can be emitted from the upper side in FIG. 1, and the other portion of light can be emitted from the lower side in FIG. 1. As a result, the state on the reverse surface side of the timepiece faceplate 1 can be prevented from being directly viewed by an observer, and the optical transmission properties of the timepiece faceplate 1 overall can be made sufficiently excellent while an excellent aesthetic appearance is imparted to the timepiece faceplate 1. Accordingly, the timepiece faceplate 1 can be advantageously applied to a solar timepiece provided with a solar battery on the reverse surface.

As described in FIG. 1, at least a portion of the numerous glossy powder particles 121 contained in the layer 12 are preferably arranged so as to be superimposed on the timepiece faceplate 1 as viewed from above. It is thereby possible to impart a particularly excellent aesthetic appearance to a timepiece faceplate 1. Since particularly excellent optical transmission properties can be imparted, the timepiece faceplate 1 can be advantageously applied to a solar timepiece.

The glossy powder particles 121 constituting the layer 12 are preferably scaly in form, and are more preferably substantially rectangular parallelepiped in form. In other words, the glossy powder particles 121 constituting the layer 12 preferably have a substantially rectangular shape when viewed from above. It is thereby possible to impart a particularly excellent aesthetic appearance to a timepiece faceplate 1. The average particle diameter of the glossy powder particles 121 is preferably 30 μm or more and 200 μm or less, more preferably 40 μm or more and 180 μm or less, and even more preferably 50 μm or more and 160 μm or less. When the average particle diameter of the glossy powder particles 121 is a value in the above-stated range, it is thereby possible to impart a particularly excellent aesthetic appearance to a timepiece faceplate 1. Since particularly excellent optical transmission properties can be imparted, the timepiece faceplate 1 can be advantageously applied to a solar timepiece. In the invention, the phrase "average diameter of the powder particles" refers to the value of the diameter of a perfect circle having the same peripheral length as the peripheral length of the powder particles when viewed from above. More specifically, the average diameter of the powder particles is $4\alpha/\pi$ [μm], where the shape of the power particles is square when viewed from above and $\alpha$[μm] is the length of one side.

The average thickness of the glossy powder particles 121 is preferably 10 μm or more and 30 μm or less, more preferably 12 μm or more and 28 μm or less, and even more preferably 14 μm or more and 26 μm or less. When the average thickness of the glossy powder particles 121 is a value within the above-stated range, incident light can be reliably reflected by the glossy powder particles 121, and a plurality of the glossy powder particles 121 can be mutually arranged with good efficiency in parts having different coordinates in the thickness direction of the layer 12. As a result, the light incident inside the layer 12 can be repeatedly reflected with good efficiency, and it is possible to impart a particularly excellent aesthetic appearance to a timepiece faceplate 1.

The average thickness of the layer 12 ($T_B$ [μm]) and the average thickness of the glossy powder particles 121 ($T_P$ [m]) preferably satisfy the relationship $0.02 \leq T_P/T_B \leq 0.50$, more preferably satisfy the relationship $0.03 \leq T_P/T_B \leq 0.45$, and even more preferably satisfy the relationship $0.04 \leq T_P/T_B \leq 0.40$. When such a relationship is satisfied, it is possible to impart a particularly excellent aesthetic appearance to a timepiece faceplate 1. Since the optical transmission properties are particularly excellent, the timepiece faceplate 1 can be more advantageously applied to a solar timepiece.

The glossy powder particles 121 may be composed of, e.g., a metal material or other material having photoluminescence (photoluminescent material), or may be composed of a laminate having a layer composed of a material such as plastic that essentially does not exhibit photoluminescence in the layer 12, and a layer composed a metal material or other material having photoluminescence (photoluminescent material). Examples of the photoluminescent material constituting the glossy powder particles 121 include Fe, Cu, Zn, Ni, Mg, Cr, Mn, Mo, Nb, Al, V, Zr, Sn, Au, Pd, Pt, Ag, and an alloy that includes at least one of the foregoing (e.g., bronze, brass, nickel silver, and the like). Among these, Cu, Al, Au, Pt, and Ag are preferred. It is thereby possible to impart a particularly excellent aesthetic appearance to a timepiece faceplate 1.

The percentage-based amount of the glossy powder particles 121 in the layer 12 is preferably 5 vol % or more and 40 vol % or less, more preferably 7 vol % or more and 35 vol % or less, and even more preferably 10 vol % or more and 33 vol % or less. When the percentage-based amount of the glossy powder particles 121 in the layer 12 is a value within the stated range, it is possible to impart a particularly excellent aesthetic appearance to a timepiece faceplate. Since the optical transmission properties are particularly excellent, the timepiece faceplate 1 can be more advantageously applied to a solar timepiece.

The curing part 122 functions as a dispersion medium for dispersing numerous glossy powder particles 121, and has a function for preventing the plurality of glossy powder particles 121 from aggregating. The incident light in the layer 12 can be repeatedly reflected with good efficiency, and it is possible to impart a particularly excellent aesthetic appearance to a timepiece faceplate. The average thickness of the layer 12 is preferably 25 μm or more and 500 μm or less, more preferably 30 μm or more and 400 μm or less, and even more preferably 40 μm or more and 350 μm or less.

The shortest distance D between the surface on which the ridges 113 of the plate-shaped member 11 are provided and the surface for reflecting light of the layer 12 (the surface of the glossy powder particles 121 in the present embodiment) is preferably 100 μm or more and 1000 μm or less, more preferably 150 μm or more and 900 μm or less, and even more preferably 200 μm or more and 850 μm or less. It is thereby possible to provide the appearance of a timepiece faceplate with a richer stereoscopic effect and a greater sense of luxury.

According to the configuration shown in the drawings, the plate-shaped member 11 and the layer 12 are arranged at a distance from each other, but the plate-shaped member 11 and the layer 12 may be in close contact with each other (or integrally formed). The timepiece faceplate 1 may have a coating layer (not shown). As described above, the timepiece faceplate 1 has excellent aesthetic appearance and excellent optical transmission properties. Accordingly, the timepiece faceplate 1 can be advantageously applied to a solar timepiece (a timepiece housed in a solar battery).

The timepiece faceplate 1 has excellent durability and can therefore be advantageously applied to a watch (e.g., a wristwatch). In FIG. 1, the layer 12 itself exists independently in the timepiece faceplate 1, but the layer 12 may be provided on, e.g., a surface of a separately prepared substrate. The stability of the shape of the layer 12 in the timepiece faceplate 1 can thereby be made sufficiently excellent even if the thickness of the layer 12 is relatively low. It is accordingly possible to minimize the amount of glossy powder particles 121 used when the timepiece faceplate 1 is manufactured, or other parameters.

Figure 12:
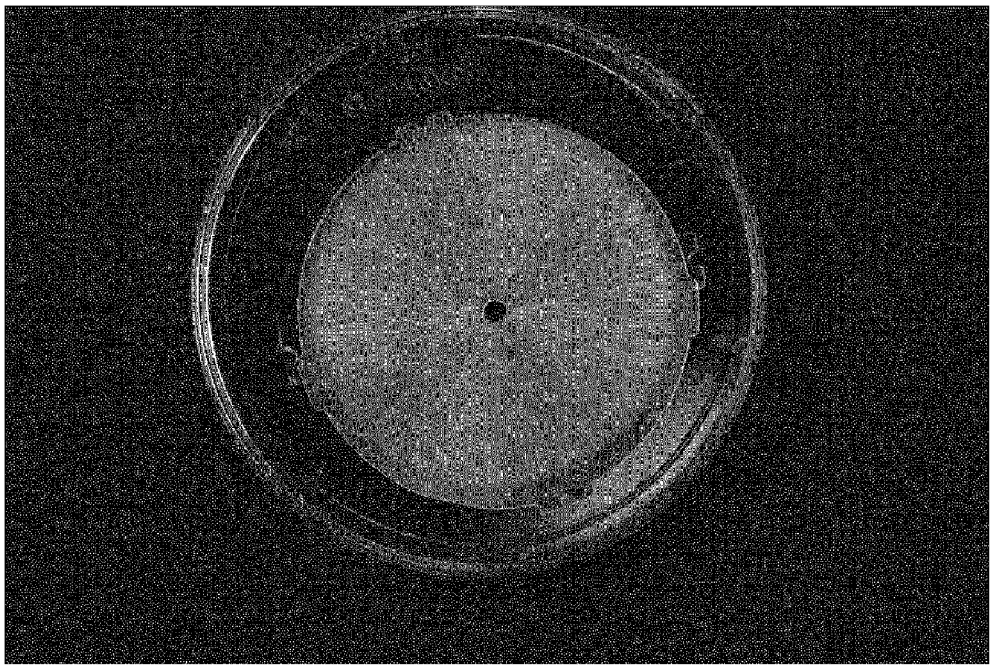
FIG. 12 is a photograph showing the timepiece faceplate of the first embodiment of the invention provided with the plate-shaped member 11 shown in FIG. 10 and the layer 12 shown in FIG. 11.

FIG. 10 shows a photograph of an example of the plate-shaped member 11 of the timepiece faceplate of the present embodiment. FIG. 11 shows a photograph of an example of the layer 12 of the timepiece faceplate of the present embodiment. FIG. 12 shows a photograph of the timepiece faceplate of the present embodiment provided with the plate-shaped member 11 shown in FIG. 10 and the layer 12 shown in FIG. 11. FIG. 10 is a photograph of the plate-shaped member taken from the first surface side provided with the ridges. FIG. 12 is a photograph taken from the surface side on which the plate-shaped member 11 of the timepiece faceplate is provided.

(Second Embodiment)

Figure 7:
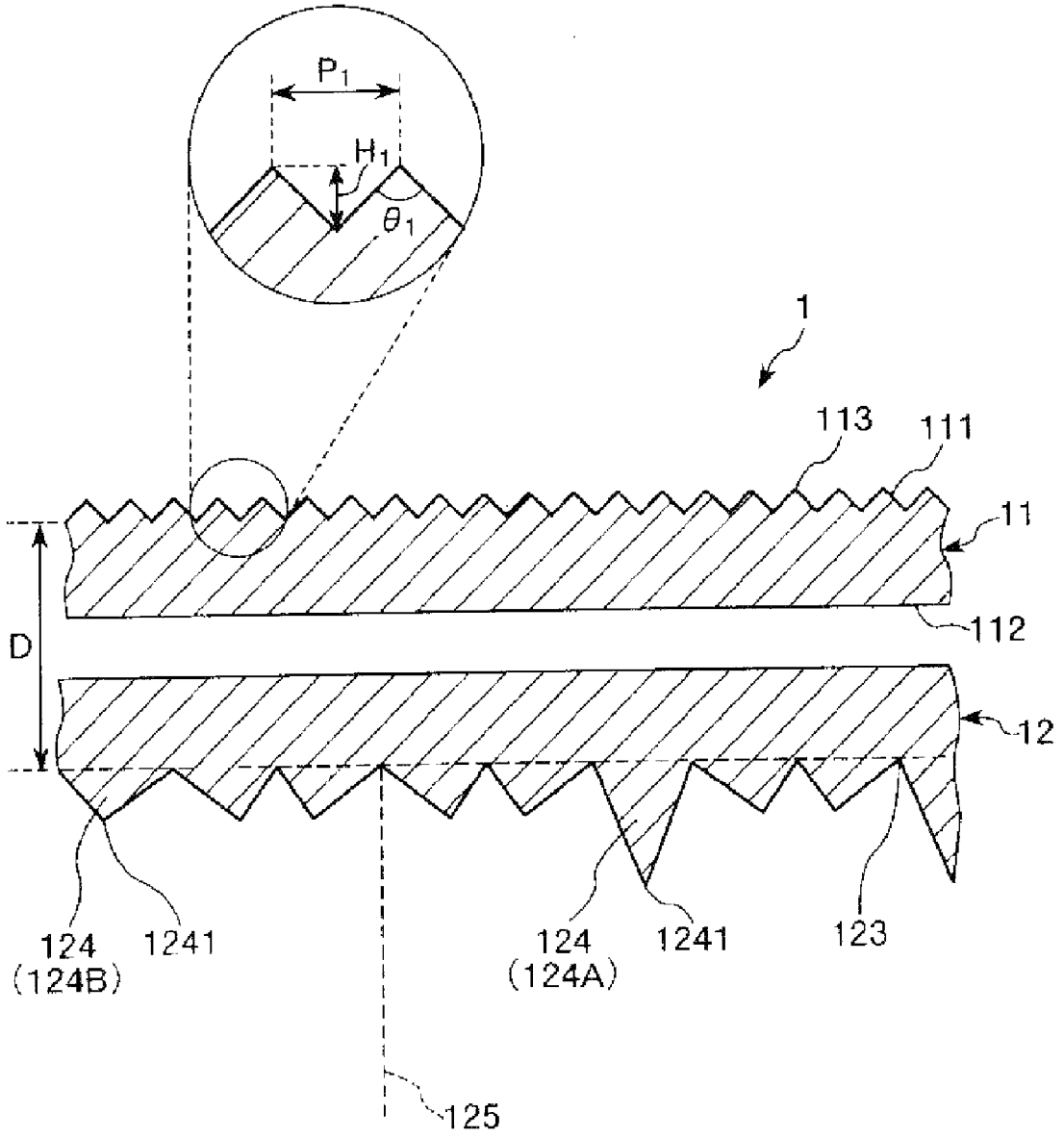
FIG. 7 is a cross-sectional view showing a second embodiment of the timepiece faceplate of the invention.
Figure 8:
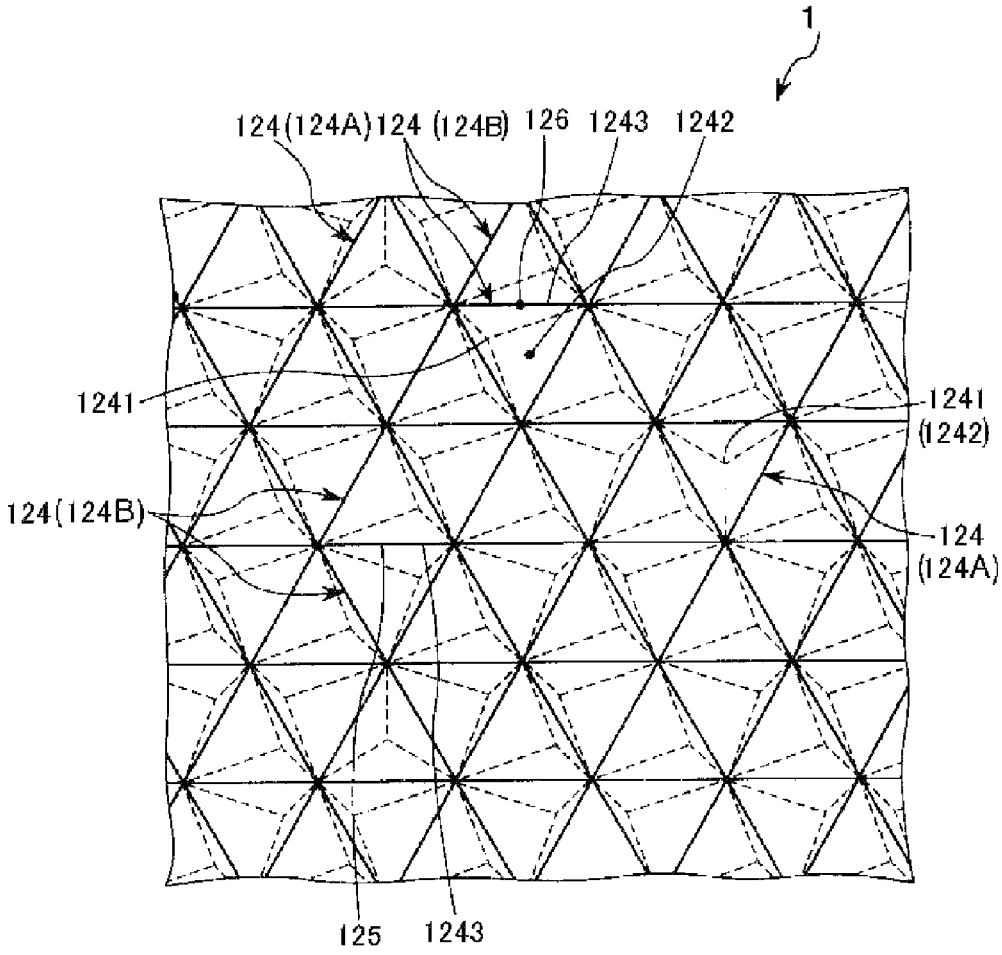
FIG. 8 is an enlarged plan view of a layer having pyramidal projections and provided to the timepiece faceplate shown in FIG. 7.
Figure 13:
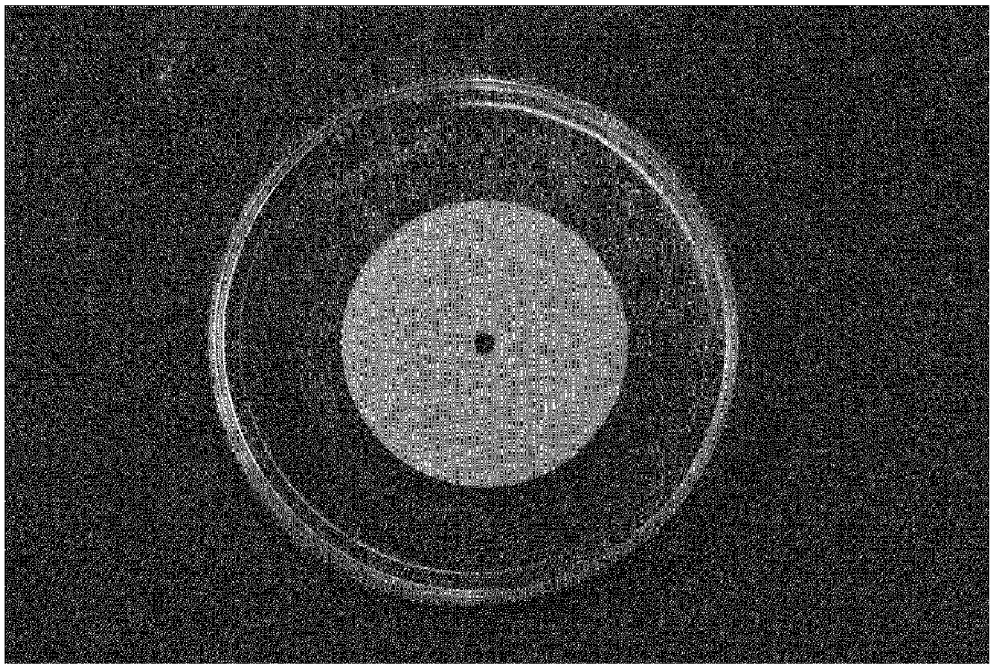
FIG. 13 is a photograph showing an example of the layer 12 of the timepiece faceplate of the second embodiment of the invention.
Figure 14:
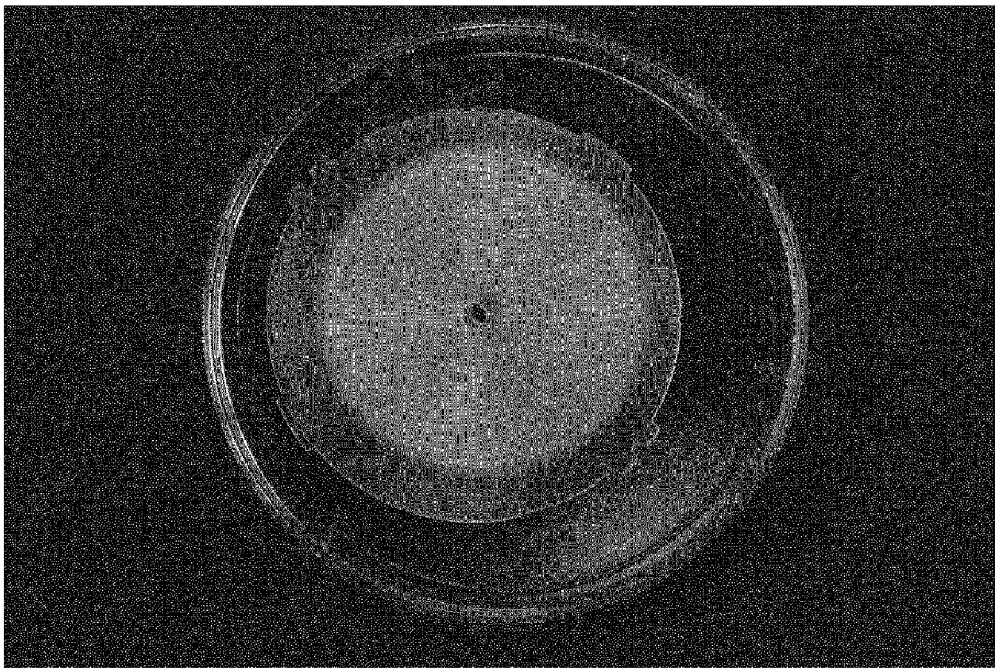
FIG. 14 is a photograph showing the timepiece faceplate of the second embodiment of the invention provided with the plate-shaped member 11 shown in FIG. 10 and the layer 12 shown in FIG. 13.

FIG. 7 is a cross-sectional view showing a second embodiment of the timepiece faceplate of the invention. FIG. 8 is an enlarged plan view of a layer having pyramidal projections and being provided to the timepiece faceplate shown in FIG. 7. FIG. 13 is a photograph showing an example of the layer 12 of the timepiece faceplate of the present embodiment. FIG. 14 is a photograph showing the timepiece faceplate of the present embodiment provided with the plate-shaped member 11 shown in FIG. 10 and the layer 12 shown in FIG. 13. The timepiece faceplate of a second embodiment is described below, and is described with respect to the points of difference from the first embodiment, and not to any points of similarity therewith.

In the timepiece faceplate 1 of the present embodiment, the layer 12, in which numerous pyramidal projections 124 are provided on one main surface (surface) 123, is provided to the surface 112 side opposite from the surface 111 on which the ridges 113 of the plate-shaped member 11 are provided. It is thereby possible to impart a particularly excellent furred appearance to a timepiece faceplate 1. According to the configuration shown in the drawings, the layer 12 has triangular pyramidal projections 124 (124A, 124B) as the projections. Thus, the layer 12 has the triangular pyramidal projections 124, thereby making it possible to provide a timepiece faceplate 1 that presents an appearance having a much more abundantly luxurious feel, such as that of mink fur.

In the configuration shown in the drawings, the layer 12 is provided with modified triangular pyramidal projections 124B as the projections 124 in which a centroid 1242 of the triangle of the bottom surface of the triangular pyramidal projections 124 when the timepiece faceplate 1 is viewed from above and the apex 1241 of the projections 124 do not match. The modified triangularly pyramidal projections 124B satisfy, between the projections 124 (124B) that are adjacent so as to share one side 1243 of the triangle of the bottom surface, a symmetrical relationship in which a plane parallel to the normal of the timepiece faceplate 1 including the side (shared side) 1243 is a plane 125 of symmetry, and/or a symmetrical relationship in which a line 126 parallel to the normal of the timepiece faceplate 1 including a point on the side (shared side) 1243 is an axis of symmetry. It is thereby possible to provide the appearance of a timepiece faceplate with a richer stereoscopic effect and a greater sense of luxury.

The modified triangular pyramidal projections 124B are preferably configured so that the centroid 1242 of the triangle of the bottom surface and the apex 1241 do not match when the timepiece faceplate 1 is viewed from above, but it is preferred that the relationship $1.0 \leq (\Delta L/L) \times 100 \leq 18.0$, and more preferably $4.0 \leq (\Delta L/L) \times 100 \leq 15.0$ be satisfied, wherein L [μm] is the length of the periphery of the triangle of the bottom surface, and ΔL [μm] is the distance between the centroid 1242 and the apex 1241 when the timepiece faceplate 1 is viewed from above. It is thereby possible to provide the appearance of a timepiece faceplate with a richer stereoscopic effect and a greater sense of luxury.

The ratio of the number of modified triangular pyramidal projections 124B among the projections 124 provided to the timepiece faceplate 1 is preferably 80% or more, more preferably 82% or more, and even more preferably 85% or more. It is thereby possible to provide the appearance of a timepiece faceplate with a richer stereoscopic effect and a greater sense of luxury. The ratio of the number of the modified triangular pyramidal projections 124B provided to the timepiece faceplate 1 that satisfy the symmetrical relationships described above (a symmetrical relationship in which a plane parallel to the normal of the timepiece faceplate that includes the shared side 1243 is used as a plane 125 of symmetry and/or a symmetrical relationship in which a line 126 parallel to the normal of the timepiece faceplate 1 that includes a point on the shared side 1243 is used as an axis of symmetry) is preferably 70% or more, more preferably 73% or more, and even more preferably 77% or more. It is thereby possible to provide the appearance of a timepiece faceplate with a richer stereoscopic effect and a greater sense of luxury.

As shown in the drawings, the bottom surface of the projections 124 provided to the timepiece faceplate 1 preferably form the shape of an isosceles triangle, and more preferably form the shape of an equilateral triangle. It is thereby possible to provide the appearance of a timepiece faceplate with a richer stereoscopic effect and a greater sense of luxury. The average value $\theta_{ave}$ of the slope angles θ (the angle θ formed by the sloped surface and the direction of the plane vertical to the normal of the layer 12; 0°<θ<90°) to the layer 12, of the sloped surfaces (the surfaces other than the bottom surface of the triangular pyramids) of the projections 124 is preferably 20° or more and 80° or less, and more preferably 40° or more and 75° or less.

The timepiece faceplate 1 is preferably provided with projections 124 having mutually different heights, as shown in FIG. 7. It is thereby possible to impart a particularly excellent aesthetic appearance to a timepiece faceplate 1. The average height of the projections 124 is preferably 10 μm or more and 500 μm or less, and more preferably 40 μm or more and 350 μm or less. It is thereby possible to impart a particularly excellent aesthetic appearance to a timepiece faceplate 1.

Among the numerous projections 124 provided to the surface 123, the ratio of those having a height in which the absolute value of the difference is 100 μm or more from the average height of the numerous projections 124 provided to the surface 123 is preferably 10% or more and 70% or less, and is more preferably 20% or more and 50% or less. It is thereby possible to impart a particularly excellent aesthetic appearance to a timepiece faceplate 1. The timepiece faceplate 1 of the present embodiment has numerous projections 124 arranged in the form of a matrix when the layer 12 (timepiece faceplate 1) is viewed from above, as shown in FIG. 8. Thus, the numerous projections 124 are arranged in an orderly fashion, thereby making it possible to impart a particularly excellent aesthetic appearance to a timepiece faceplate 1. The average surface area of the projections 124 when the layer 12 is viewed from above is preferably $1\times10^3$ μm$^2$ or more and $1\times10^{10}$ μm$^2$ or less, and more preferably $1\times10^4$ μm$^2$ or more and $1\times10^8$ μm$^2$ or less. It is thereby possible to impart a particularly excellent aesthetic appearance to a timepiece faceplate 1. In the case that the overall layer 12 has optical transmission properties, the optical transmission properties of the overall timepiece faceplate 1 can be made sufficiently excellent and the timepiece faceplate 1 can be advantageously applied to a solar timepiece.

FIG. 13 shows a photograph of an example of the layer 12 of the timepiece faceplate of the present embodiment. FIG. 14 shows a photograph of the timepiece faceplate of the present embodiment provided with the plate-shaped member 11 shown in FIG. 10 and the layer 12 shown in FIG. 13. FIG. 13 is a photograph of the surface side opposite the surface of the layer 12 on which the projections 124 are provided. FIG. 14 is a photograph taken from the surface side on which the plate-shaped member 11 of the timepiece faceplate is provided.

<Timepiece>

Described next is the timepiece of the invention provided according to the timepiece faceplate of the invention described above. The timepiece of the invention has the timepiece faceplate of the invention described above. As described above, the timepiece faceplate of the invention presents a furred appearance that has been impossible to achieve in the past, and has excellent decorative properties (aesthetic appearance). Excellent optical transmission properties can be imparted to the timepiece faceplate 1 overall while an excellent appearance such as that described above can be ensured by the selection of the materials of the plate-shaped member 11 and layer 12. Accordingly, the timepiece of the invention provided with such a timepiece faceplate can sufficiently satisfy the requirements of a solar timepiece. It is possible to use known components other than the timepiece faceplate constituting the timepiece of the invention (the timepiece faceplate of the invention), and an example of the configuration of the timepiece of the invention is described below.

Figure 9:
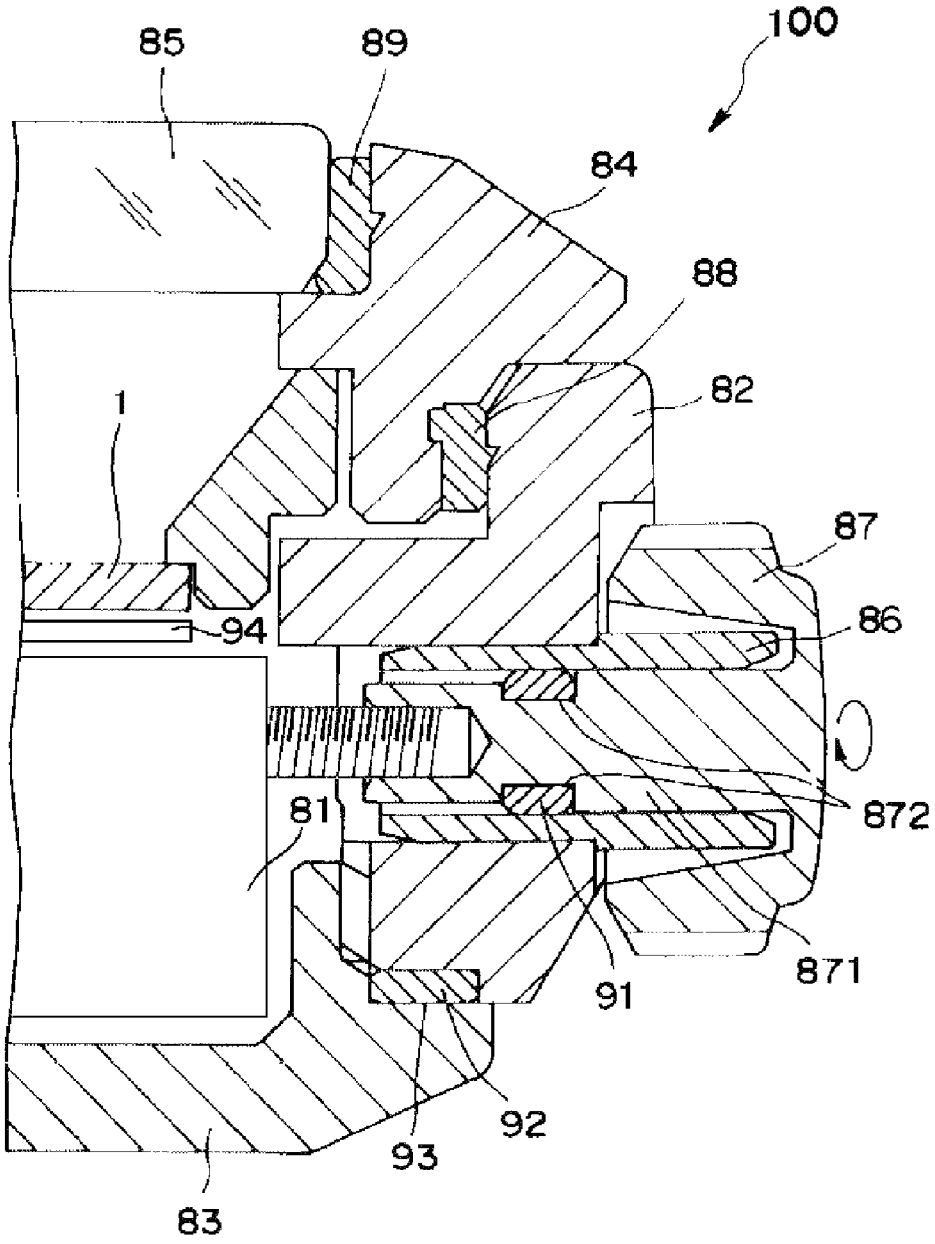
FIG. 9 is a partial cross-sectional view showing a preferred embodiment of the timepiece (portable timepiece) of the invention.

FIG. 9 is a cross-sectional view showing a preferred embodiment of the timepiece (portable timepiece) of the invention. A wristwatch (portable timepiece) 100 of the present embodiment is provided with a case body (case) 82, a case back 83, a bezel (edge) 84, and a glass plate (cover glass) 85, as shown in FIG. 9. The timepiece faceplate 1 of the invention as described above, a solar battery 94, and a movement 81 are accommodated in the case 82; and hands (indicator; not shown) or the like are also accommodated. The timepiece faceplate 1 is provided between the solar battery 94 and the glass plate (cover glass) 85, and the first surface 111 of the plate-shaped member 11 is arranged so as to face the glass plate (cover glass) 85 side.

The glass plate 85 is ordinarily composed of transparent glass, sapphire, or another high-transparency material. The aesthetic properties of the timepiece faceplate 1 of the invention can thereby be sufficiently demonstrated, and a sufficient amount of light can be allowed to be incident on the solar battery 94. The movement 81 drives the hands using the electromotive force of the solar battery 94. Although not shown in FIG. 9, there are provided inside the movement 81, e.g., an electric double layer capacitor for storing the electromotive force of the solar battery 94, a lithium-ion secondary battery, a crystal oscillator as a time reference source, a semiconductor integrated circuit for generating a drive pulse for driving the timepiece on the basis of the oscillating frequency of the crystal oscillator, a step motor for driving the hands in one second increments on the basis of the drive pulse, a going train mechanism for transmitting the movement of the step motor to the hands, and other components.

The movement 81 is provided with an antenna (not shown) for receiving radio waves, and has a function for performing time adjustment or the like using the received radio waves. The solar battery 94 has a function for converting light energy into electric energy. The electric energy converted by the solar battery 94 is used for driving the movement and for other purposes. The solar battery 94 has, e.g., a p-i-n structure in which a p-type impurity and an n-type impurity are selectively introduced into non-single crystal silicon thin films, and an i-type non-single crystal silicon thin film having a low impurity concentration is provided between the p-type non-single crystal silicon thin film and the n-type non-single crystal silicon thin film.

A stem pipe 86 is fitted into and secured to the case 82, and a shaft part 871 of a crown 87 is rotatably inserted into the stem pipe 86. The case 82 and bezel 84 are secured by a plastic gasket 88, and the bezel 84 and glass plate 85 are secured by a plastic gasket 89. The case back 83 is fitted (or threaded) onto the case 82, and a ring-shaped rubber gasket (case back gasket) 92 is inserted in a compressed state into these joining parts (seal parts) 93. This configuration fluid-tightly seals the seal parts 93, and a waterproof function is obtained.

A groove 872 is formed in the outer periphery of the crown 87 partway along the shaft part 871, and a ring-shaped rubber gasket (crown gasket) 91 is fitted into the groove 872. The rubber gasket 91 is in close contact with the internal peripheral surface of the stem pipe 86, and is compressed between the internal peripheral surface and the inner surface of the groove 872. This configuration fluid-tightly seals the crown 87 and the stem pipe 86, and a waterproof function is obtained. When the crown 87 is rotatably operated, the rubber gasket 91 rotates together with the shaft part 871, and slides in the peripheral direction while in close contact with the internal peripheral surface of the stem pipe 86. A portable timepiece (wristwatch) such as that described above is a timepiece that requires particularly excellent durability (e.g., shock resistance, and the like). Therefore, the invention can be more advantageously applied in that an excellent aesthetic appearance and excellent durability are obtained.

In the description above, a wristwatch (portable timepiece) that is a solar radio wave timepiece was described as an example of a timepiece, but the invention can also be similarly applied to portable timepieces, fixed timepieces, hanging timepieces, and a variety of other types of timepieces besides wristwatches. The invention can also be applied to solar timepieces excluding solar/radio wave timepieces, radio wave timepieces excluding solar/radio wave timepieces, and any other timepiece. Preferred embodiments of the invention are described above, but the invention is not limited to the description above.

For example, in the timepiece faceplate and the timepiece of the invention, the configuration of each of the parts can be substituted with any configuration that demonstrates the same function, and any configuration may be added. An example of such an addition is a printed part formed by various printing methods.

In the embodiments described above, the ridges of the plate-shaped member are described as being provided to the entire first surface, but the ridges may be selectively provided to only a portion of the first surface.

What is claimed is:

1. A timepiece faceplate, comprising:

a plate-shaped member having a first side part that includes a ridge, the ridge having a function for reflecting and scattering incident light, the plate-shaped member being made of a material having optical transmission properties; and a layer including a plurality of projections disposed on one main surface thereof, the projections including at least first, second, third, and fourth pyramid-shaped projections each having an apex, each of the second, third, and fourth pyramid-shaped projections being disposed next to the first pyramid-shaped projection with each of the second, third, and fourth pyramid-shaped projections connecting the first pyramid-shaped projection, the layer being separated from the plate-shaped member, the plate-shaped member and the layer being superimposed when viewed from above, at least the first and second pyramid-shaped projections each having a modified tetrahedron-shape with a triangular base and three triangular side faces that meet in the apex, with the triangular base having a centroid that is offset relative to the apex when viewed from above, the first and second pyramid-shaped projections being adjacently arranged relative to each other such that the triangular bases of the first and second pyramid-shaped projections share a common side thereof, and such that the first and second pyramid-shaped projections satisfy at least one of a plane-symmetrical relationship with respect to an imaginary plane that is parallel to a normal direction of the timepiece faceplate and includes the common side of the first and second pyramid-shaped projections, and an axis-symmetrical relationship with respect to an imaginary axis that is parallel to the normal direction of the timepiece faceplate and intersects with the common side of the first and second pyramid-shaped projections.

2. The timepiece faceplate according to claim 1, wherein the ratio of the number of the first and second pyramid-shaped projections having the modified tetrahedron-shape among the projections provided to the timepiece faceplate is 80% or higher.

3. The timepiece faceplate according to claim 1, wherein the ratio of the number of the first and second pyramid-shaped projections having the modified tetrahedron-shape that satisfy the one of the plane-symmetrical relationship and the axis-symmetrical relationship is 70% or higher.

4. The timepiece faceplate according to claim 1, wherein the triangular bases of the first and second pyramid-shaped projections have a shape of an isosceles triangle.

5. The timepiece faceplate according to claim 1, wherein the plate-shaped member further includes a second side part opposed to the first side part, the layer has a first surface part that faces the second side part of the plate-shaped member and is opposed to the one main surface, and the first surface part of the layer and the second side part of the plate-shaped member are spaced apart from each other.

6. The timepiece faceplate according to claim 5, wherein the plate-shaped member and the layer are arranged such that a gap exists between the second side part of the plate-shaped member and the first surface part of the layer.

* * * * *